United States Patent [19]

Lee

[11] Patent Number: 5,016,872

[45] Date of Patent: May 21, 1991

[54] HYDRAULIC TYPE STATIONARY CYCLE EXERCISE

[76] Inventor: Sunny Lee, 3 Fl., No. 31, Alley 27, Lane 372, Sec. 5, Chung Hsiao E. Rd., Taipei, Taiwan

[21] Appl. No.: 536,420

[22] Filed: Jun. 11, 1990

[51] Int. Cl.[5] ..... A63B 21/00

[52] U.S. Cl. ..... 272/73; 272/70; 272/130

[58] Field of Search ..... 272/70, 73, 130, 96

[56] References Cited

U.S. PATENT DOCUMENTS

| | | | |
|---|---|---|---|
| 4,463,945 | 8/1984 | Spector | 272/73 |
| 4,509,742 | 4/1985 | Cones | 272/73 |
| 4,729,559 | 3/1988 | McNeil | 272/130 X |
| 4,750,735 | 6/2988 | Furgerson et al. | 272/130 X |
| 4,949,954 | 8/1990 | Hix | 272/73 |

*Primary Examiner*—Stephen R. Crow
*Assistant Examiner*—Glenn E. Richman
*Attorney, Agent, or Firm*—Rogers, Howell & Haferkamp

[57] ABSTRACT

A hydraulic type stationary cycle exerciser includes a base frame. On a rear upper beam of the base frame there is mounted a seat support on which a seat is provided. A cylinder is pivotably mounted to a front upper beam of the base frame at one end thereof and a lever arm is fixedly mounted to a pivot point of the cylinder such that the lever arm follows the cylinder to pivotally move between a forwardmost position and a backwardmost position.

4 Claims, 3 Drawing Sheets

HYDRAULIC TYPE STATIONARY CYCLE EXERCISE

BACKGROUND OF THE INVENTION

The present invention relates to a hydraulic type stationary cycle exerciser, particularly to a hydraulic type stationary cycle exerciser with two cylinders to provide a reciprocating movement of a lever arm of the cycle exerciser upon revolution of a pedaling means.

Conventional stationary cycle exercisers are of a chain type or belt type in which a plurality of mechanical elements such as a chain or a belt, a ratchet, a flywheel and a pedaling means, etc. are required. However, such a chain type or belt type cycle exerciser is high in cost and easily damaged because of a plurality of requisite mechanical elements. Furthermore, noise is produced due to the chain movement during transmission.

SUMMARY OF THE INVENTION

It is an object of the present invention to provide a hydraulic type stationary cycle exerciser in which the manufacturing cost is largely reduced in comparison with a conventional chain type or belt type stationary cycle exerciser.

It is another object of the present invention to provide a hydraulic type stationary cycle exerciser in which the risk of damage to machine is largely reduced in comparison with a conventional chain type or belt type stationary cycle exerciser.

It is still another object of the present invention to provide a hydraulic type stationary cycle exerciser with low noise in comparison with a conventional chain type or belt type stationary cycle exerciser.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENTS

Figure 1:
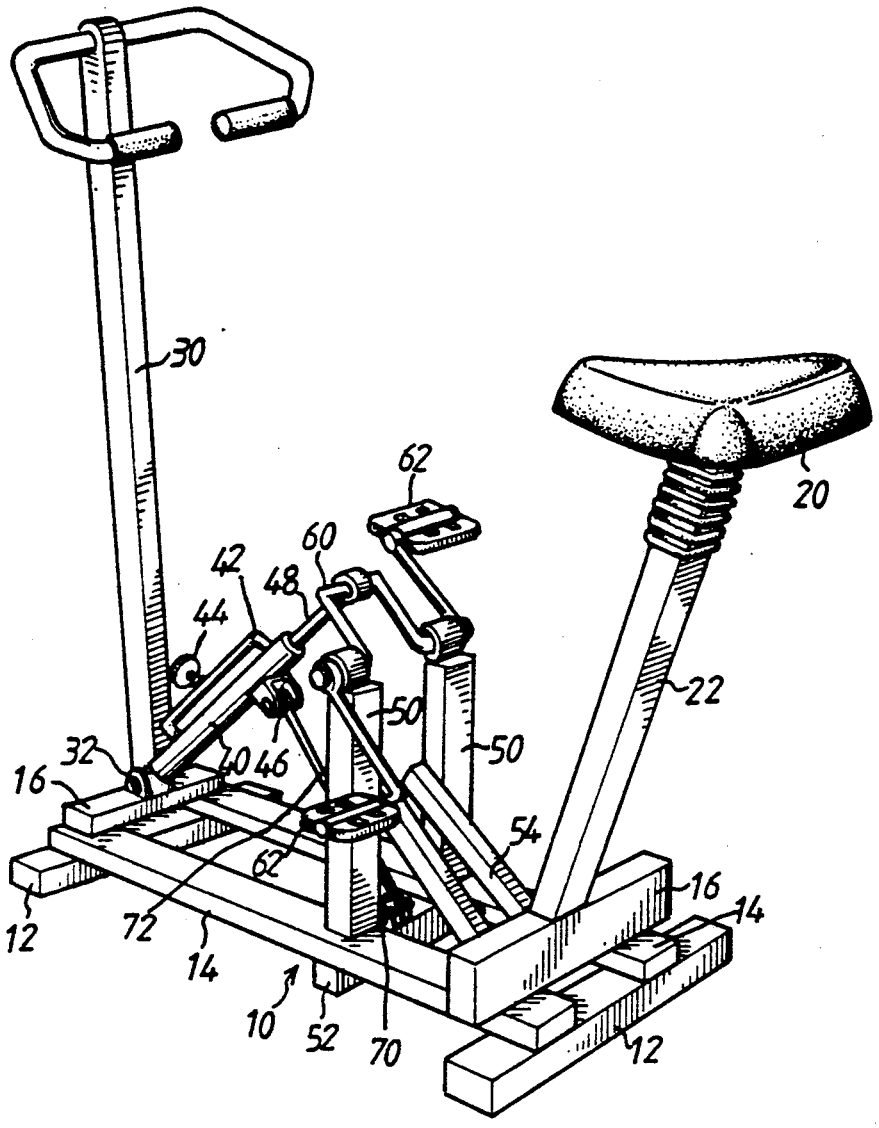
FIG. 1 is a perspective view of a hydraulic type stationary cycle exerciser in accordance with the present invention.
Figure 2:
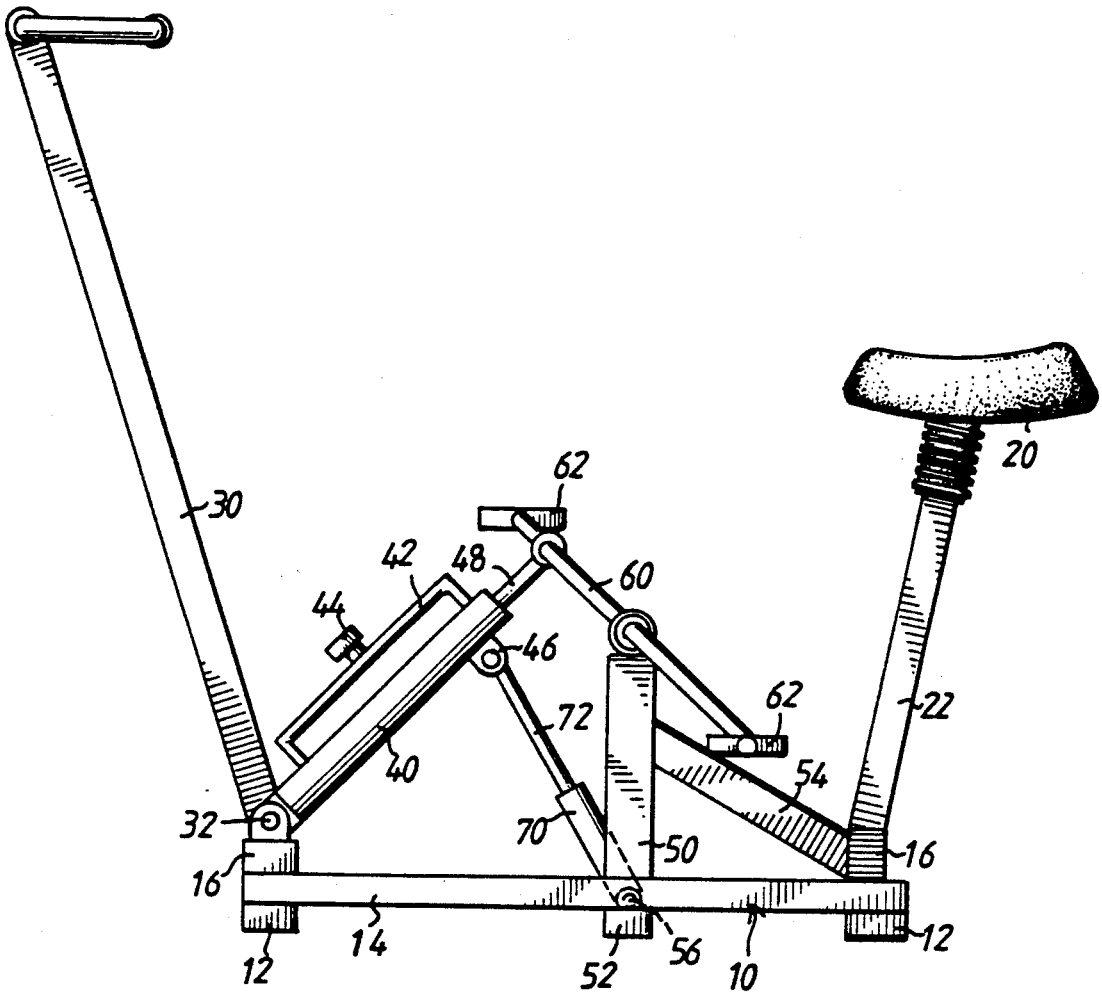
FIG. 2 is a schematic side view of a hydraulic type stationary cycle exerciser in accordance with the present invention in which a lever arm of the cycle exerciser is at a forward position.
Figure 3:
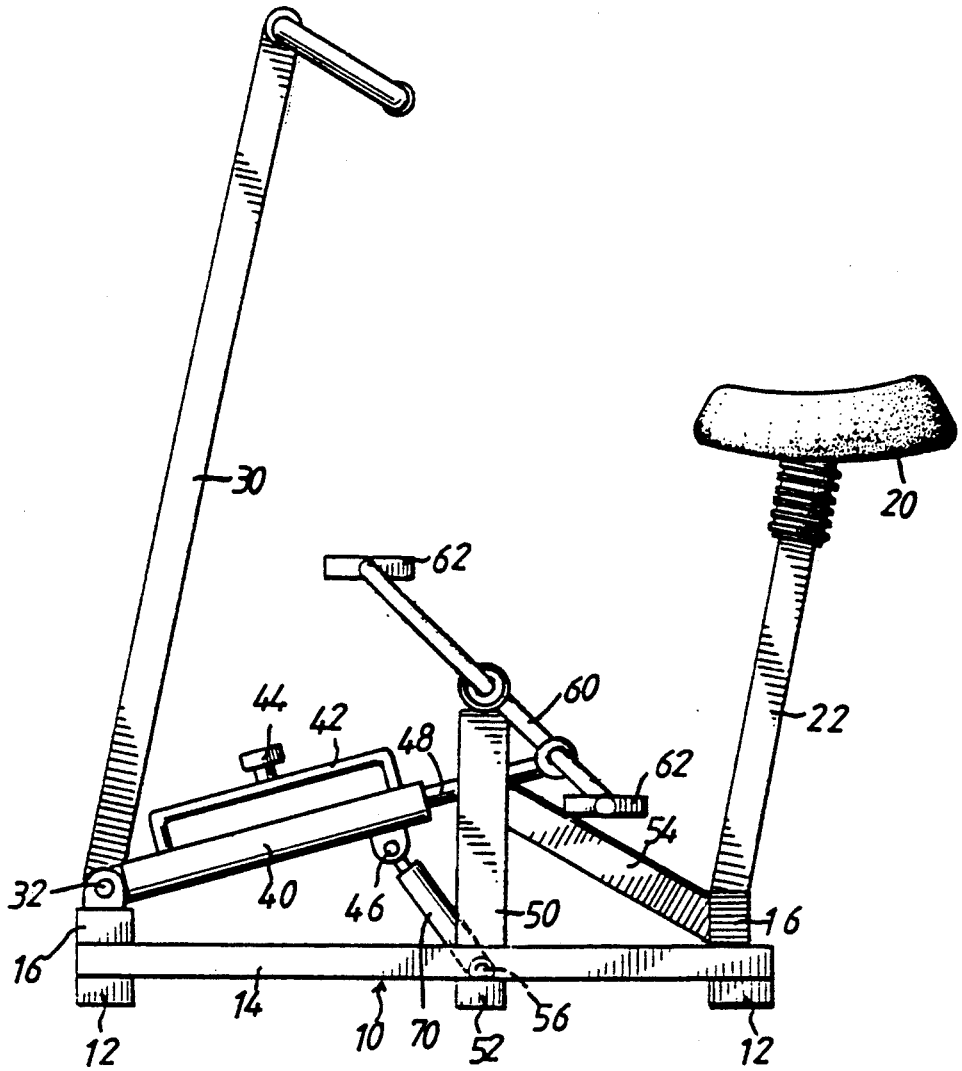
FIG. 3 is a schematic side view of a hydraulic type stationary cycle exerciser of FIG. 2 in which the lever arm of the cycle exerciser is at a backward position.

Please refer to FIGS. 1 to 3. The hydraulic type stationary cycle exerciser according to the present invention comprises a base frame 10 composed of two spaced lower beams 12, two spaced cross beams 14 mounted on the lower beams 12 and two spaced upper beams 16 mounted across the cross beams 14.

On the rear upper beam 16 there is mounted a seat support 22 on which a seat 20 is provided. A primary cylinder 40 is pivotably mounted to the front upper beam 16 at one end thereof by means of a pivot 32 and a lever arm 30 is fixedly mounted at the pivot point of the primary cylinder 40 such that the lever arm 30 follows the primary cylinder 40 to pivotally move between a forwardmost position and a backwardmost position.

Each cross beam 14 has a pedal mount 50, disposed between the front upper beam 16 and the rear upper beam 16, on which a pedaling means 60 with two opposed pedals 62 are mounted. A piston 48 of the primary cylinder 40 is attached to a middle point of the pedaling means 60 at a distal end thereof. Beneath the two pedal mounts 50 there is a beam 52 mounted to an under side of the two cross beams 14 and extends transversely to a plane on which the two cross beams 14 locates. An auxiliary cylinder 70 is fixedly mounted on the beam 52 between the two cross beams 14 at an end 56 thereof and has an acute angle with the pedal support 50. A piston 72 of the auxiliary cylinder 70 is attached to an underside of the primary cylinder 40 at a pivot 46.

In the boat-rowing operation of the present cycle exerciser, a person cycles the pedal 62 of the pedaling means 60 which in turn pushes and pulls the piston 48 of the primary cylinder 40. Accordingly, the lever arm 30 moves with the first cylinder 40 to pivot between the forwardmost and the backwardmost position due to the revolution of the pedaling means 60. FIG. 2 shows the lever arm 30 in its forwardmost position, and in FIG. 3 the lever arm 30 is shown in its backwardmost position. An oil pipe 42 is provided on the primary cylinder 40 for communicating between two chambers within the primary cylinder 40 defined by the piston head (not shown) of the primary cylinder 40 to form a passage for the working fluid therein so as to make the boat-rowing operation of the present cycle exerciser more smooth. An adjustable valve 44 is provided on the oil pipe 42 for adjusting the flow within the oil pipe 42 such that the pressure within the primary cylinder can be adjusted for exercise.

Still referring to FIGS. 2 and 3, the piston 72 of the auxiliary cylinder 70 also follows the primary cylinder to reciprocatingly move between an upstroke and a backstroke. It would be appreciated that the auxiliary cylinder is provided to eliminate the found break occurring in the utilization of single primary cylinder during the boat-rowing operation of the present cycle exerciser and to make the boat-rowing operation more smooth. Please note that the auxiliary cylinder also can be provided with an oil pipe and an adjustable valve as provided on the primary cylinder. Furthermore, a pair of post 54 are provided between the base frame 10 and the two pedal mounts 50 to provide a reinforced structure for the boat-rowing operation of the present cycle exerciser.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A hydraulic type stationary cycle exerciser comprising:

a base frame;

a seat support being mounted on a rear portion of said base frame and a seat being mounted on said seat support;

a pedal mounting means being mounted on a middle portion of said base frame, a pedaling means being mounted on said pedal mounting means;

a primary cylinder being pivotably mounted to a front portion of said base frame at one end thereof, a piston of said primary cylinder being attached to a middle point of said pedaling means at a distal end thereof, a lever arm being fixedly mounted to a pivot point of said primary cylinder at one end thereof such that said lever arm follows said primary cylinder to pivotally move between a forwardmost position and a backwardmost position upon revolution of said pedaling means;

a beam being mounted to said base frame beneath said pedal mounting means;

an auxiliary cylinder being fixedly mounted on said beam at an end thereof and having an acute angle with said pedal mounting means, a piston of said auxiliary cylinder being attached to an underside of said primary cylinder at a pivot thereof.

2. A hydraulic type stationary cycle exerciser as claimed in claim 1 further comprising an oil pipe communicating between two chambers within said primary cylinder defined by a piston head of said primary cylinder and an adjustable valve being provided on said oil pipe for adjusting a flow within said oil pipe.

3. A hydraulic type stationary cycle exerciser as claimed in claim 1 further comprising an oil pipe communicating between two chambers within said auxiliary cylinder defined by a piston head of said auxiliary cylinder and an adjustable valve being provided on said oil pipe for adjusting a flow within said oil pipe.

4. A hydraulic type stationary cycle exerciser as claimed in claim 1 further comprising posting means provided between said base frame and said pedal mounting means to provide a reinforced structure for the boat-rowing operation of said cycle exerciser.

* * * * *